United States Patent [19]

Ito

[11] 4,429,834

[45] Feb. 7, 1984

[54] MOUTH CLOSURE ASSEMBLY FOR MOUTH OF FOAM LIQUID DISPENSING CONTAINER

[75] Inventor: Kazuo Ito, Kamakura, Japan

[73] Assignee: Toyo Seikan Kaisha, Ltd., Tokyo, Japan

[21] Appl. No.: 348,146

[22] Filed: Feb. 11, 1982

[30] Foreign Application Priority Data

Apr. 13, 1981 [JP] Japan ..... 56-52884[U]

[51] Int. Cl.[3] ..... B65D 1/32

[52] U.S. Cl. ..... 239/327; 222/189; 222/190; 222/212; 222/524; 239/539

[58] Field of Search ..... 222/149, 189, 190, 211, 222/212, 521, 524, 525; 239/327, 343, 370, 458, 538–539, 541

[56] References Cited

U.S. PATENT DOCUMENTS

| | | | |
|---|---|---|---|
| 3,227,332 | 1/1966 | Gowdy et al. | 222/525 |
| 3,283,966 | 11/1966 | Miller | 222/525 |
| 3,511,420 | 5/1970 | Kessler | 222/525 |
| 3,622,049 | 11/1971 | Thompson | 239/343 X |
| 3,709,437 | 1/1973 | Wright | 239/343 |
| 4,156,505 | 5/1979 | Bennett | 239/327 |

*Primary Examiner*—Andres Kashnikow

*Attorney, Agent, or Firm*—Charles A. Brown

[57] ABSTRACT

A mouth closure assembly for the mouth of a foam liquid dispensing container adapted to mix foamable liquid and air together and dispense the mixture in the form of a foam aerosol. The mouth closure assembly comprises a foaming portion fitted in the mouth of the dispensing container and including a check valve and a porous member and a foam liquid dispensing portion surrounding the foaming portion and including a cavity defined therein and a closure cap fitted on the top of the foam liquid dispensing portion. The foam liquid dispensing portion covers both the foaming portion and container mouth and is secured to the mouth.

8 Claims, 2 Drawing Figures

MOUTH CLOSURE ASSEMBLY FOR MOUTH OF FOAM LIQUID DISPENSING CONTAINER

FIELD OF THE INVENTION

This invention relates to a mouth closure assembly for the mouth of a foam liquid dispensing container which is adapted to mix foamable liquid and air together and dispense the mixture in the form of foam sol and which enables replacing air to flow easily and rapidly into the container in repetition.

PRIOR ARTS

There have been proposed and practically employed a variety of mouth closure assemblies for the mouths of foam liquid dispensing containers, but any one of the prior art mouth closure assemblies for the mouths of foam liquid dispensing containers is complicate in construction and requires a great number of parts and as a result, the prior art mouth closure assemblies have the disadvantage that they are difficult to assemble the parts together.

And in the prior art mouth closure assemblies for the mouths of foam liquid dispensing containers, in order to dispense foam liquid in a metered amount in repetition, the open air has to be passed into the interior of the dispensing container taking a rather long time and as a result, the prior art mouth assemblies have the disadvantage that they encounter difficulties in dispensing foam liquid in a predetermined amount in repetition.

SUMMARY OF THE INVENTION

Therefore, one purpose of the present invention is to provide a mouth closure assembly for the mouth of a foam liquid dispensing container formed of elastic material such as thermoplastic synthetic resin which is adapted to mix foamable liquid and air together in a suitable ratio and dispense the mixture in the form of foam liquid in a metered amount and which is simpler in construction and production.

Another object of the present invention is to provide a mouth closure assembly for the mouth of a foam liquid dispensing container which is adapted to rapidly dispense foam liquid in a metered amount in repetition.

Another object of the present invention is to provide a mouth closure assembly for the mouth of a foam liquid dispensing container which is adapted to dispense foam sol in a predetermined amount in repetition, which has replaceable components and which has a pleasant external appearance.

A further object of the present invention is to provide a mouth closure assembly for the mouth of a foam liquid dispensing container which can be used in any position and which is adapted to easily dispense foam sol in a metered amount.

The above and other object and attendant advantages of the present invention will be more readily apparent to those skilled in the art from a reading of the following detailed description in conjunction with the accompanying drawing which shows one preferred embodiment of the present invention for illustration purpose only, but not for limiting the scope of the same in any way.

PREFERRED EMBODIMENT OF THE INVENTION

Figure 2:
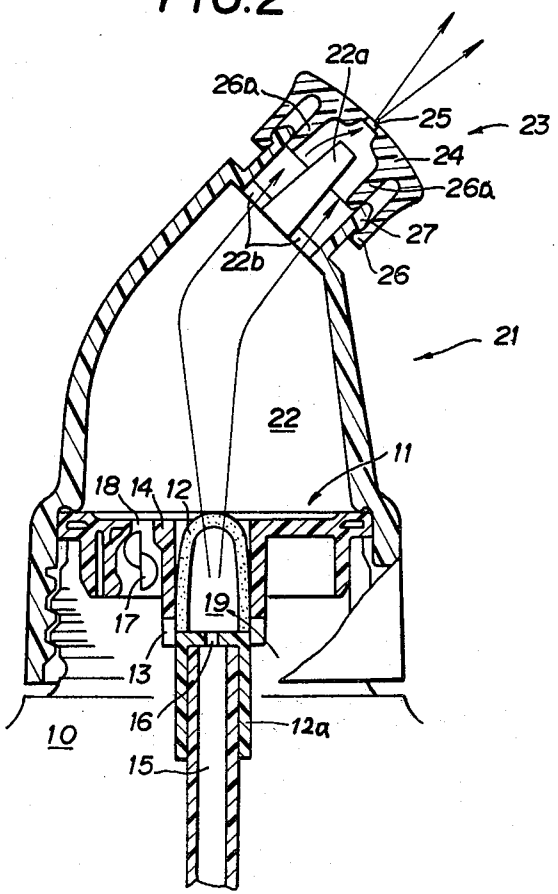
FIG. 2 is similar to FIG. 1, but shows the foam liquid dispensing port being uncovered.
Figure 1:
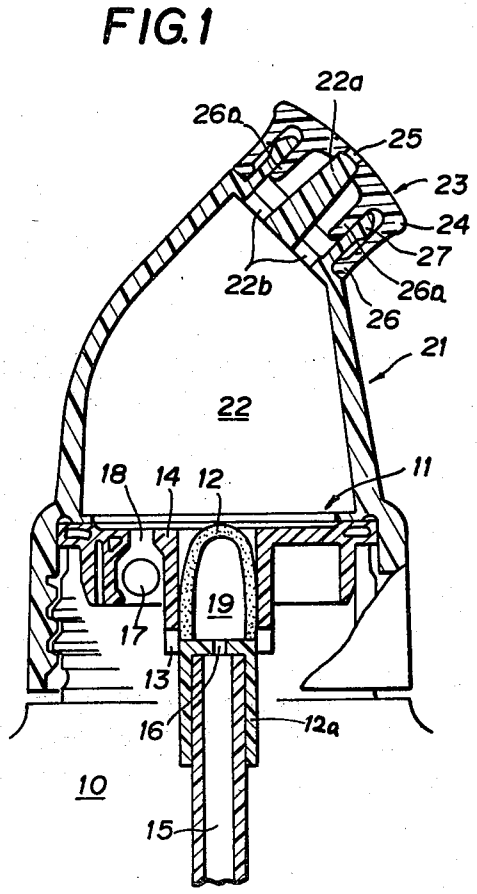
FIG. 1 is a vertically sectional view of the mouth closure assembly for the mouth of a foam liquid dispensing container constructed in accordance with the present invention showing the foam liquid dispensing port being closed by the closure cap.

The present invention will be now described referring to the accompanying drawing which shows one preferred embodiment of the mouth closure assembly for the mouth of a squeezable foam liquid dispensing container of the invention. Shown in FIGS. 1 and 2 is the mouth closure assembly for the mouth of a squeezable foam liquid dispensing container which is foamed of elastic material such as thermoplastic synthetic resin and generally shown by reference numeral 10 (the container is partially shown in these Figures). The mouth closure assembly generally comprises an inner foaming portion 11 fitted in the externally threaded mouth of the container 10 and an outer foam liquid dispensing portion 21 surrounding both the inner foaming portion 11 and the container mouth and formed with external threads for threaded engagement with the externally threaded container mouth. The inner foaming portion 11 includes an inverted U-shaped porous foaming member 12 uprightly disposed in the center of the container mouth and defining a mixing chamber 19 therein, an inverted U-shaped pipe holder **12*a* positioned right below and depending from the porous foaming member 12 and formed in the top thereof with a through hole 16 in communication with the mixing chamber 19 defined by the porous member 12, a pipe 15 fitted in and depending from the pipe holder 12*a* and a holder 14 for the porous foaming member 12 having through holes 13 in the peripheral wall thereof for the purpose to be described hereinbelow. The holder 14 is formed with an air vent hole 18 through which air passes and a check valve 17** is disposed within the holder and normally assumes the open position when the container is disposed as shown in these Figures.

The outer form liquid dispensing portion 21 tapers upwardly and terminates at the inclined top and includes a cavity 22 defined by the hollow interior thereof, and upwardly tapered plug member **22*a* extending upwardly and outwardly from the inclined top, an annular engaging projection 27 extending upwardly and outwardly from the inclined top in spaced surrounding relationship to the plug member and having a bulge on the outer surface of the leading or outer end portion thereof and through holes 22*b* formed in the inclined top between the plug member 22*a* and engaging projection 27**.

A closure cap 23 normally closes the outer foam liquid dispensing portion 21 and includes a foam liquid dispensing port 25 formed in the top 24 of the cap, an annular engaging projection 26 extending inwardly from the top 24 and having a bulge on the inner surface of the lower end portion thereof for engaging the bulge on the engaging projection 27 and an annular guide **26*a* extending inwardly from the top 24 in inwardly spaced relationship to the engaging projection 26 for guiding the engaging projection 27 therealong. The annular guide 26*a* is shorter than the engaging projection 26. When the foam liquid dispensing container is not used, the engaging projection 26 seats on the inclined top of the foam liquid dispensing portion 21 and the plug member 22*a* enters the dispensing port 25** to close the port.

The mating bulges on the engaging projections 26, 27 cooperate with each other to prevent the closure cap 23 from coming off the dispensing portion 21 when the dispensing port 25 in the closure cap 23 is opened for dispensing foam liquid from the container 10.

With the above-mentioned construction and arrangement of the components of the container, when the foam liquid is desired to be dispensed from the container, first of all, the closure cap 23 is pulled up from the dispensing portion 21 until the bulge on the engaging projection 26 engages the mating bulge on the engaging projection 27 whereupon the dispensing port 25 is uncovered and the dispensing container 10 is then turned upsidedown.

When the container is turned upsidedown, the check valve 17 falls down by its own gravity within the porous member holder 14 to clog the air vent hole 18. With the air vent hole 18 maintained in the closed condition, an external squeezing force is applied to the container 10 on the side thereof, the pressure within the container increases so as to cause the check valve 17 to clog the air vent hole 18 more positively. The foamable liquid within the container flows under pressure through the through holes 13 in the porous member holder 12 into the mixing chamber 19 defined in the porous member 12 and at the same time, the air within the container 10 flows through the pipe 15 and the through hole 16 in the pipe holder 12*a* into the mixing chamber 19 to mix with the foamable liquid flowing into the chamber to form a mixture which then flows through the pores in the porous member 12 out of the member 12 into the cavity 22 defined in the foam liquid dispensing portion 21 as a foam liquid having foams distributed uniformly therein. The foam liquid is then flowed from the cavity 22 through the through holes 22*b* in the top of the dispensing portion 21 to the dispensing port 25 in the closure cap 23 from where the foam liquid is dispensed.

When the external squeezing force applied to the container 10 on the side thereof is released from the container, the container returns to the normal or original shape by the restoring force inherent to the elastic material of the container whereupon the pressure within the container decreases and the air from the atmosphere enters the dispensing port 25 and flows through the cavity 22 to push the check valve 17 to uncover the air vent hole 18 whereby the air is allowed to flow through the air vent hole 18 into the body of the container 10.

Even if the container is used in its normal upright position with the mouth disposed top or any inclined position with respect to the vertical, when the container is squeezed on the side thereof, the internal pressure of the container increase to push the check valve 17 up to clog the air vent hole 18. So long as the external squeezing force is maintained on the container, the air under pressure within the container is forced to flow through the through holes 13 and the pores in the porous member 12 into the mixing chamber 19 therein and at the same time, the foamable liquid is forced to flow from the body of the container through the pipe 15 and the through hole 16 in the pipe holder 12*a* into the mixing chamber 19 where the liquid mixes with the incoming air to form an air-liquid mixture which then flows through the pores in the porous member 12 out of the member 12 as the foam liquid having foams distributed uniformly therein and the foam liquid is dispensed through the dispensing port 25. Thereafter, when the external squeezing force is removed from the container, the container returns to its original shape by the restoring force inherent to the elastic material of the container whereupon the internal pressure of the decreases. The decrease in the internal pressure allows the check valve 17 to drop by its gravity so as to uncover the air vent hole 18 whereby the air from the atmosphere is allowed to enter the container 10 easily and rapidly.

Since the above-mentioned liquid forming and open air inflow are attained by the action of the foaming portion 11, the foam liquid dispensing portion 21 is merely required to be designed to include the cavity 22 having shape and size suitable for the foam liquid and open air to pass therethrough.

Since the cavity 22 is merely required to have shape and size suitable for the foam liquid and open air to pass therethrough, the shape and size of the cavity are not limited to particular ones. Thus, the foam liquid dispensing portion 21 may extend uprightly with the surface of the top thereof laying in a horizontal plane or be disposed in various other orientations within the scope of the invention other than that illustrated in FIGS. 1 and 2.

Furthermore, according to the present invention, since the container mouth closure assembly comprises the inner foaming portion 11 and the outer foam liquid dispensing portion 21 surrounding the foaming portion and thus, the mouth closure assembly can be applied to various other containers other than the illustrated container 10 by replacing only the foam dispensing portion 21 with ones suitable for the other containers. As mentioned hereinabove, since the container mouth closure assembly of the present invention comprises the inner foaming portion 11 including the check valve 17 and porous member 12 and the internally threaded outer foam liquid dispensing portion 21 surrounding the foaming portion 11 and including the cavity 22 defined therein and the closure cap 23 fitted on the top of the foam liquid dispensing portion 21 to normally close the container to seal the content within the container from the open air, the mouth closure assembly of the invention has the advantage that the external appearance of the foam liquid dispensing portion 21 can be varied within a wide range by varying the orientation of the foam liquid dispensing portion.

Therefore, the mouth closure assembly of the invention has the advantage that the same one foaming portion 11 can be employed in conjunction with foam liquid dispensing portion having various other shapes and/or orientations without departing from the scope of the present invention.

In the foregoing description has been made of only one specific embodiment of the invention, but it will readily occur to those skilled in the art that the same is illustrative in nature, but does not limit the scope of the invention in any way. The scope of the invention is only limited by the appended claims.

What is claimed is:

1. A mouth closure assembly for the mouth of a squeezable foam liquid dispensing container, comprising an inner foaming portion fitted in said mouth of the container and including foamable liquid and air mixing means, air guide means for guiding air into said mixing means, a mixing means holder and replacing air inflow control means; and a detachable outer foam liquid dispensing portion surrounding said container mouth and said inner foaming portion and including a cavity defined therein in communication with said mixing means and a closure cap for closing said cavity, said mixing means including a porous member defining a mixing chamber therein and supported by a holder fitted in said mouth of the container, said porous member having through holes, said air guide means including a pipe positioned immediately below and depending from said porous member and communicating with the interior of said containter, a pipe holder interposed between said porous member and said pipe and formed with a through hole communicating between said mixing chamber and pipe, and said air inflow control means including an air vent hole formed in said porous member holder and a check valve disposed in said porous member holder for closing and uncovering said air vent hole.

2. The mouth closure assembly for the mouth of a squeezable foam liquid dispensing container as set forth in claim 1, in which said outer foam liquid dispensing portion tapers upwardly and terminating in a inclined top and includes an upwardly tapered plug extending upwardly and outwardly from said inclined top in the center of the top, a first annular engaging projection extending upwardly and outwardly from said top in spaced surrounding relationship to said plug and having engaging means and through air holes formed in said top intermediate between said plug and annular engaging projection; and said closure cap includes a foam liquid dispensing port formed in the top of the closure cap for receiving said plug, a second annular engaging projection extending inwardly from the top of the closure cap and having engaging means for cooperation with said engaging means on the first annular engageing projection and guide means extending inwardly from said top of the closure cap in inwardly spaced relationship to the second annular engaging projection for guiding said first engaging projection therealong.

3. A mouth closure assembly for the mouth of a squeezable foam liquid dispensing container, comprising;

(a) an inner foaming portion fitted in said mouth of the container and including,
- a porous foaming member defining a mixing chamber therein in which foamable liquid and air are mixed, and supported by a holder fitted in said mouth of the container, said holder including a wall portion having a through hole,
- air guide means for guiding air into said mixing chamber from the interior of the container,
- foam liquid guide means for guiding liquid into said mixing chamber from the interior of the container, and
- air inflow control means including an air vent hole and a check valve for selectively closing and uncovering said air vent hole, (b) a detachable outer foam liquid dispensing portion surrounding said container mouth and said inner foaming portion and including,
- a cavity defined therein in communication with said porous member, and
- a closure cap for closing said cavity, and (c) a pipe, a pipe holder depending from said wall portion of said holder and receiving an upper end of said pipe with said pipe being positioned immediately below and depending from said porous member and communicating with the interior of the container, and said through hole communicating between said mixing chamber and said pipe.

4. The mouth closure assembly as set forth in claim 3, wherein said pipe forms said air guide means, and through holes provided in a cylindrical wall portion of said holder for said porous foaming member form said foam liquid guide means.

5. The mouth closure assembly as set forth in claim 4 in which (a) said outer foam liquid dispensing portion defining said cavity therein tapers upwardly and terminates in an inclined top,
- said top includes an upwardly tapering plug extending upwardly and outwardly from said inclined top in the center of said top,
- a first annular engaging projection extends upwardly and outwardly from said top in spaced surrounding relationship to said plug and has engaging means, and
- through air holes formed in said top between said plug and annular engaging projection, and (b) said closure cap includes,
- a foam liquid dispensing port formed in a top thereof for receiving said plug,
- a second annular engaging projection extending inwardly from the top of said closure cap and having means for cooperation with said engaging means on said first annular engaging projection, and
- guide means extending inwardly from the top of said closure cap in inwardly spaced relation to said second annular engaging projection for guiding said first engaging projection therealong.

6. The mouth closure assembly as set forth in claim 3, wherein said pipe held by said pipe holder forms said foam liquid guide means, and through holes provided in a cylindrical wall portion of said holder for said porous foaming member form said air guide means.

7. The mouth closure assembly as set forth in claim 6 in which (a) said outer foam liquid dispensing portion defining said cavity therein tapers upwardly and terminates in an inclined top,
- said top includes an upwardly tapering plug extending upwardly and outwardly from said inclined top in the center of said top,
- a first annular engaging projection extends upwardly and outwardly from said top in spaced surrounding relationship to said plug and has engaging means, and
- through air holes formed in said top between said plug and annular engaging projection, and (b) said closure cap includes,
- a foam liquid dispensing port formed in a top thereof for receiving said plug,
- a second annular engaging projection extending inwardly from the top of said closure cap and having engaging means for cooperation with said engaging means on said first annular engaging projection, and
- guide means extending inwardly from the top of said closure cap in inwardly spaced relation to said second annular engaging projection for guiding said first engaging projection therealong.

8. The mouth closure assembly as set forth in claim 3 in which (a) said outer foam liquid dispensing portion defining said cavity therein tapers upwardly and terminates in an inclined top, said top includes an upwardly tapering plug extending upwardly and outwardly from said inclined top in the center of said top, a first annular engaging projection extends upwardly and outwardly from said top in spaced surrounding relationship to said plug and has engaging means, and through air holes formed in said top between said plug and annular engaging projection, and (b) said closure cap includes, a foam liquid dispensing port formed in a top thereof for receiving said plug, a second annular engaging projection extending inwardly from the top of said closure cap and having engaging means for cooperation with said engaging means on said first annular engaging projection, and guide means extending inwardly from the top of said closure cap in inwardly spaced relation to said second annular engaging projection for guiding said first engaging projection therealong.

* * * * *